US009604352B2

(12) United States Patent
Kobayashi et al.

(10) Patent No.: US 9,604,352 B2
(45) Date of Patent: Mar. 28, 2017

(54) IMPACT TOOL

(71) Applicant: MAX CO., LTD, Tokyo (JP)

(72) Inventors: Tsuyoshi Kobayashi, Tokyo (JP); Norihiro Nagai, Tokyo (JP); Yasushi Yokochi, Tokyo (JP)

(73) Assignee: MAX CO., LTD., Tokyo (JP)

( * ) Notice: Subject to any disclaimer, the term of this patent is extended or adjusted under 35 U.S.C. 154(b) by 722 days.

(21) Appl. No.: 14/019,832

(22) Filed: Sep. 6, 2013

(65) Prior Publication Data

US 2014/0069980 A1 Mar. 13, 2014

(30) Foreign Application Priority Data

Sep. 12, 2012 (JP) ..... 2012-200146

(51) Int. Cl.
*B25C 1/08* (2006.01)

(52) U.S. Cl.
CPC ..... *B25C 1/08* (2013.01)

(58) Field of Classification Search
CPC ..... B25C 1/08; B25C 1/008
USPC ..... 227/2
See application file for complete search history.

(56) References Cited

U.S. PATENT DOCUMENTS 4,316,512 A * 2/1982 Kibblewhite ..... G01D 5/24404 173/183
5,794,831 A * 8/1998 Velan ..... B25C 1/001 173/20
6,123,241 A 9/2000 Walter et al.
7,284,511 B2 10/2007 Zahner et al.
8,123,095 B2 * 2/2012 Dittrich ..... B25C 1/08 227/10
8,397,967 B2 * 3/2013 Calvet ..... B25C 1/08 227/10
8,701,957 B2 * 4/2014 Grandjean ..... B25C 1/08 227/130
2007/0101954 A1 5/2007 Zahner et al.
2007/0215664 A1 * 9/2007 Moeller ..... B25C 1/08 227/2
2008/0011251 A1 1/2008 Tanaka
2008/0223895 A1 9/2008 Fujisawa
2009/0000801 A1 * 1/2009 Calvet ..... B25C 1/08 173/210
2009/0051306 A1 2/2009 Matsunaga et al.
2009/0223691 A1 9/2009 Ikuta et al.
2011/0240708 A1 10/2011 Kobayashi
(Continued)

FOREIGN PATENT DOCUMENTS

CN A-101372095 2/2009
CN A-101524836 9/2009
(Continued)

*Primary Examiner* — Gloria R Weeks
(74) *Attorney, Agent, or Firm* — Drinker Biddle & Reath LLP

(57) ABSTRACT

An impact tool can be operated by generating an impact using an internal mechanism. The impact tool includes a control unit and sensors. The control unit controls the internal mechanism. The sensors output a signal for operating the internal mechanism or a signal for preparing the operation of the internal mechanism, to the control unit. Until a predetermined condition is established after the internal mechanism is operated, the control unit does not accept the input of the sensors.

5 Claims, 3 Drawing Sheets

(56) References Cited

U.S. PATENT DOCUMENTS

2012/0118932 A1 5/2012 Largo et al.

FOREIGN PATENT DOCUMENTS

| | | | |
|---|---|---|---|
| EP | 1782925 | A1 | 5/2007 |
| EP | 1980367 | A2 | 10/2008 |
| EP | 2210710 | A1 | 7/2010 |
| JP | A-H8-276376 | | 10/1996 |
| JP | T-H9-507172 | | 7/1997 |
| JP | A-2005-319579 | | 11/2005 |
| JP | A-2008-018513 | | 1/2008 |
| JP | A-2009-226513 | | 10/2009 |
| JP | 2011-212828 | A | 10/2011 |
| TW | 2005-23080 | A | 7/2005 |

* cited by examiner

IMPACT TOOL

CROSS-REFERENCE TO RELATED APPLICATION

This application is based on and claims priority under 35 USC119 from Japanese Patent Application No. 2012-200146 filed on Sep. 12, 2012.

TECHNICAL FIELD

The invention relates to an impact tool which operates by generating an impact using its internal mechanism. For example, it relates to a gas combustion type driving tool which operates a drive piston using the combustion pressure of gas fuel to thereby drive a fastening member, a pneumatic driving tool operates a drive piston using the pneumatic pressure of compressed air to thereby drive a fastening member, an electric driving tool, a rotary driving tool such as an impact driver and an impact wrench, and the like.

BACKGROUND

This type of impact tool incorporates multiple sensors therein and can be operated with the detection results of the sensors as a trigger.

For example, a gas combustion type fastening tool includes various sensors, for example, a gas can sensor for detecting the opening/closing of the cover of a gas can, a contact sensor for detecting that a contact arm has been pressed against a driven member, and a trigger sensor for detecting that a trigger has been pulled. And, according to the detection results of these sensors, the gas combustion type fastening tool is allowed to start its predetermined operation.

For example, in a gas combustion type fastening tool disclosed in the JP-A-2011-212828, when a contact sensor detects that a contact arm has been pressed against a driven member, gas fuel is supplied from a gas can to a combustion chamber and also, in the combustion chamber, a fan is rotated to start an operation to mix the gas fuel with the air. Also, when a trigger sensor detects that a trigger has been pulled, the mixed gas within the combustion chamber is ignited for combustion, and the combustion energy of the mixed gas is used to drive a drive piston.

SUMMARY

However, in the impact tool, since a heavy impact is generated, there is a possibility that such impact can cause the sensors to malfunction. This makes it necessary to take some measures, in order to prevent the gas from being injected and to prevent an ignition spark from being generated at timing not intended by a user due to the malfunction of the sensors, thereby securing the safety of the tool, and also in order to prevent wasteful gas injection and power consumption.

To solve the problems raised by the malfunction of the sensors, in a currently used impact tool, an impact damping device such as a damper or an impact absorbing mechanism is provided to absorb and dampen impacts applied to the sensors. According to such structure, even when heavy impacts are generated in the impact tool, it is possible to greatly reduce the possibility that the sensors can malfunction.

However, when there are taken the measures using a mechanical structure such as a damper, a part such as an impact damping device or an impact absorbing mechanism is added and a space for provision of the impact damping device or impact absorbing mechanism is necessary. This increases the size of the tool and the weight of the main body of the tool and thus increases the manufacturing cost of the tool.

Thus, this invention aims at providing an impact tool which can prevent the malfunction of sensors caused by an impact without employing a mechanical structure such as an impact damping device or an impact absorbing mechanism.

That is, this invention provides the following characteristics.

(Claim 1)

The invention described in Claim 1 provides the following characteristics.

An impact tool described in Claim 1 is workable by generating an impact using an internal mechanism. The impact tool includes a control unit and a sensor. The control unit controls the internal mechanism. The sensor outputs a signal for operating the internal mechanism or a signal for preparing an operation of the internal mechanism, to the control unit. The control unit does not accept an input of the sensor until a predetermined condition is established after the internal mechanism is operated.

(Claim 2)

The invention described in Claim 2 provides the following characteristics in addition to the characteristics of the above invention described in Claim 1.

In the impact tool, the predetermined condition is that a predetermined time passes since the control unit received the signal for operating the internal mechanism, or, that a predetermined time passes since the control unit transmits the signal for operating the internal mechanism.

(Claim 3)

The invention described in Claim 3 provides the following characteristics in addition to the characteristics of the above invention described in Claim 1.

The impact tool further includes an impact sensor. The impact sensor detects an impact generated by the internal mechanism. The predetermined condition is that a magnitude of the impact to be detected by the impact sensor is a predetermined threshold value or less.

(Claim 4)

The invention described in Claim 4 provides the following characteristics in addition to the characteristics of the above invention described in any one of Claims 1 to 3.

In the impact tool, the impact tool is a gas combustion type fastening tool for driving a fastening member by operating a drive piston using combustion pressure. The fastening tool includes a gas injection device for injecting gas fuel into a combustion chamber and an ignition plug for generating a spark for combusting a mixed gas constituted of the gas fuel and air. The sensor includes first and second sensors. The first sensor outputs at least any one of a signal for operating the gas injection device and a signal for operating a fan for stirring up the air within the combustion chamber, to the control unit. The second sensor outputs a signal for operating the ignition plug to the control unit. The control unit, until the predetermined condition is established after the internal mechanism is operated, does not accept an input of at least any one of the first and second sensors.

(Claim 5)

The invention described in Claim 5 provides the following characteristics in addition to the characteristics of the above invention described in any one of Claims 1 to 3.

In the impact tool, the impact tool is a gas combustion type fastening tool for driving a fastening member by operating a drive piston using combustion pressure. The fastening tool includes a gas injection device for injecting gas fuel from a gas can into a combustion chamber and an ignition plug for generating a spark for combusting a mixed gas constituted of the gas fuel and air. The sensor includes first, second and third sensors. The first sensor outputs at least any one of a signal for operating the gas injection device and a signal for operating a fan for stirring up the air within the combustion chamber, to the control unit. The second sensor outputs a signal for operating the ignition plug to the control unit. The third sensor outputs a signal when the gas can is detected. The control unit, until the predetermined condition is established after the internal mechanism is operated, does not accept an input of at least any one of the first, second and third sensors.

(Claim 1)

The invention according to Claim 1 is as described above, in which the control unit does not accept the input of the sensors until a predetermined condition is established after the internal mechanism is operated. That is, since at least one of the sensors for outputting signals necessary to operate the internal mechanism is nullified when an impact is generated, even when the sensors are caused to malfunction by the impact, the internal mechanism is prevented against operation. Thus, the malfunction caused by the impact can be prevented without using a mechanical structure such as an impact damping device or an impact absorbing mechanism.

(Claim 2)

The invention according to Claim 2 is as described above, in which the above-mentioned predetermined condition is that a predetermined time has passed since the control unit received a signal for operating the internal mechanism (for example, after it received a signal from the trigger sensor), or, that a predetermined time has passed since it transmitted a signal for operating the internal structure (for example, it transmitted a signal for causing the ignition plug to generate an ignition spark). In other words, until a predetermined time has passed since the impact was generated, at least one of the sensors for outputting signals necessary to operate the internal mechanism is nullified. With this structure, the malfunction can be prevented in terms of software without adding a new part.

(Claim 3)

The invention according to Claim 3 is as described above, in which there is provided the impact sensor for detecting an impact to be generated by the internal mechanism and the above-mentioned predetermined condition is that the magnitude of the impact to be detected by the impact sensor is a predetermined threshold value or less. In other words, until the impact dies away after generated, at least one of the sensors for outputting signals necessary to operate the internal mechanism is nullified. With this structure, the malfunction can be prevented even when the time necessary for the impact to die away is indefinite. Therefore, even in a tool such as an impact driver or an impact wrench which operates continuously for an indefinite time, the malfunction can be prevented.

(Claim 4)

The invention according to Claim 4 is as described above, in which the control unit in the gas combustion type fastening tool does not accept of the input of any one of the first sensor for outputting to the control unit any one of a signal for operating the gas injection device and a signal for operating the fan for stirring up the air within the combustion chamber and the second sensor for outputting to the control unit a signal for operating the ignition plug until a predetermined condition is established after the internal mechanism is operated. Therefore, when the impact is generated, it is possible to prevent the gas fuel from being injected, the fan from being operated and the ignition plug from being operated at a time not intended by a user due to the malfunction of the sensors.

(Claim 5)

The invention according to Claim 5 is as described above, in which, until a predetermined condition is established after the internal mechanism is operated, the control unit in the gas combustion type fastening tool does not accept of the input of any one of the first sensor for outputting to the control unit any one of a signal for operating the gas injection device and a signal for operating the fan for stirring up the air within the combustion chamber, the second sensor for outputting to the control unit a signal for operating the ignition plug, and the third sensor for outputting a signal when the gas can is detected until a predetermined condition is established after the internal mechanism is operated. Therefore, when the impact is generated, it is possible to prevent the gas fuel from being injected, the fan from being operated and the ignition plug from being operated at a time not intended by a user due to the malfunction of the sensors. Also, the gas can is originally held by an elastic member such as a spring within the gas combustion type fastening tool. When the holding position of the gas can is caused to shift instantaneously due to the impact, it is possible to avoid the wrong determination that the gas can is absent.

DETAILED DESCRIPTION

An embodiment of the invention is described below with reference to a gas combustion type fastening tool 10 shown in FIG. 1.

Figure 1:
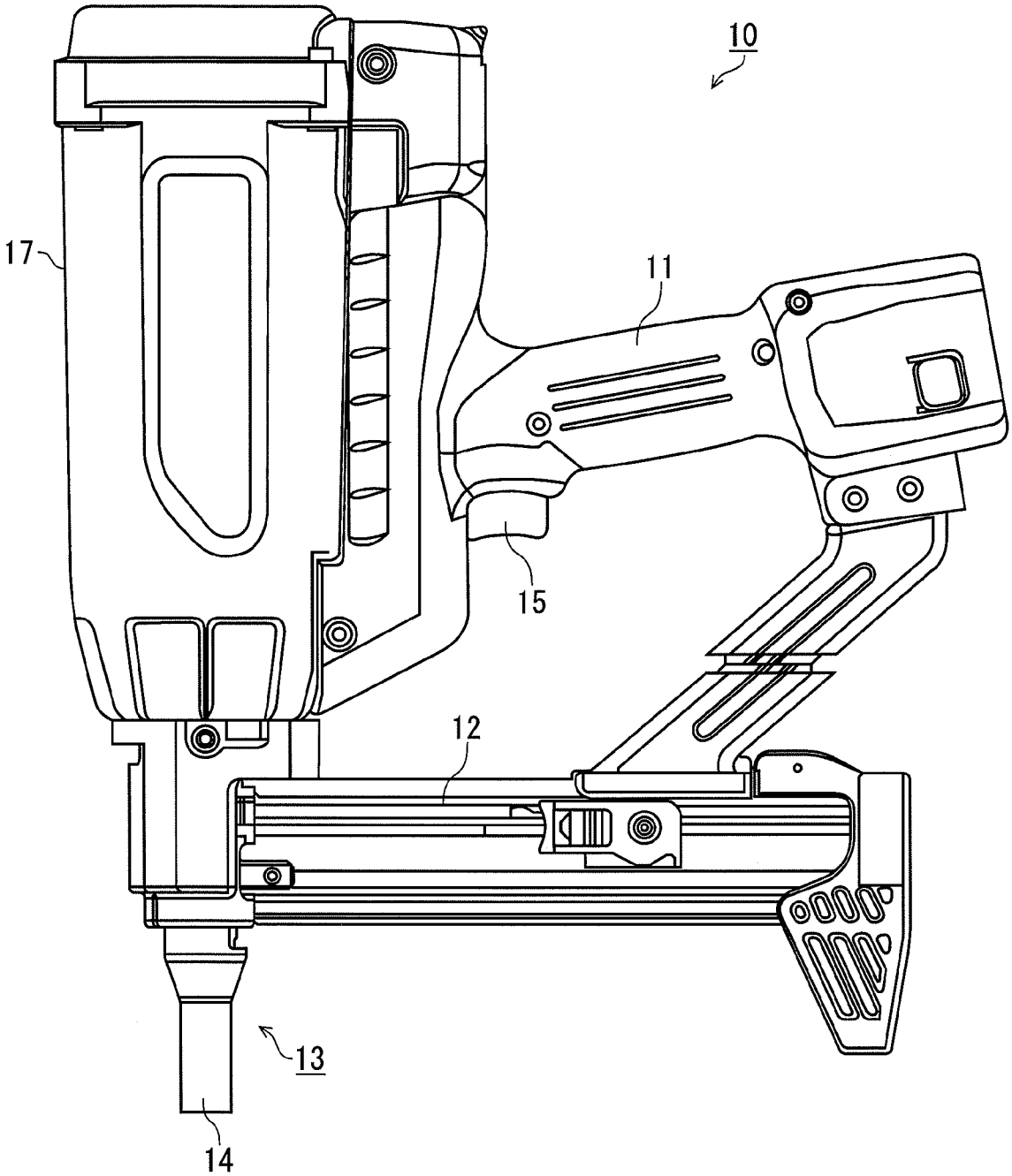
FIG. 1 is an external view of a gas combustion type fastening tool.

The gas combustion type fastening tool 10 according to this embodiment, as shown in FIG. 1, includes a grip 11 and a magazine 12 respectively attached to the rear end of a body 17, while a nose portion 13 for driving out a nail is provided on and projected from the lower portion of the body 17.

Although not shown specifically, the body 17 incorporates therein a drive piston/cylinder mechanism serving as an internal mechanism for generating an impact. In this drive piston/cylinder mechanism, a drive piston is slidably stored within a drive cylinder and a driver is integrally connected to the lower portion of the drive piston. And, a combustion chamber is formed in the upper portion of the drive cylinder.

Within this combustion chamber, there are provided: a gas injection nozzle portion for injecting a combustible gas into the combustion chamber from a gas injection device 330 disposed on the body 17 or grip 11; a fan 18 for mixing the combustible gas injected into the combustion chamber with the air existing within the combustion chamber to generate a mixed gas having a predetermined air fuel ratio; and, an ignition plug 310 for generating a spark for combusting the mixed gas mixed by the fan 18.

Here, the fan 18 can be rotated by a fan motor 320, while the fan motor 320 is a DC motor which can be rotated by obtaining a dc drive pressure from a battery 20 disposed within the fastening tool 10.

The driving of the fan motor 320 and the operation of the ignition plug 310 are controlled by a control substrate 100 provided within the grip 11, whereby the driving of the drive piston/cylinder mechanism is controlled indirectly. On this control substrate 100, there are mounted: a microcomputer 110 serving as a control unit; a power supply circuit 120 for stabilizing the drive pressure from the battery 20 and then supplying it to the microcomputer 110; a fan motor drive circuit 130 for controlling the driving of the fan motor 320; a high voltage generator circuit 140 for causing the ignition plug 310 to generate an ignition spark; and, a gas injection device drive circuit 150 for causing the gas injection device 330 to inject the gas fuel, which has been filled into the gas can 16, into the combustion chamber.

Figure 2:
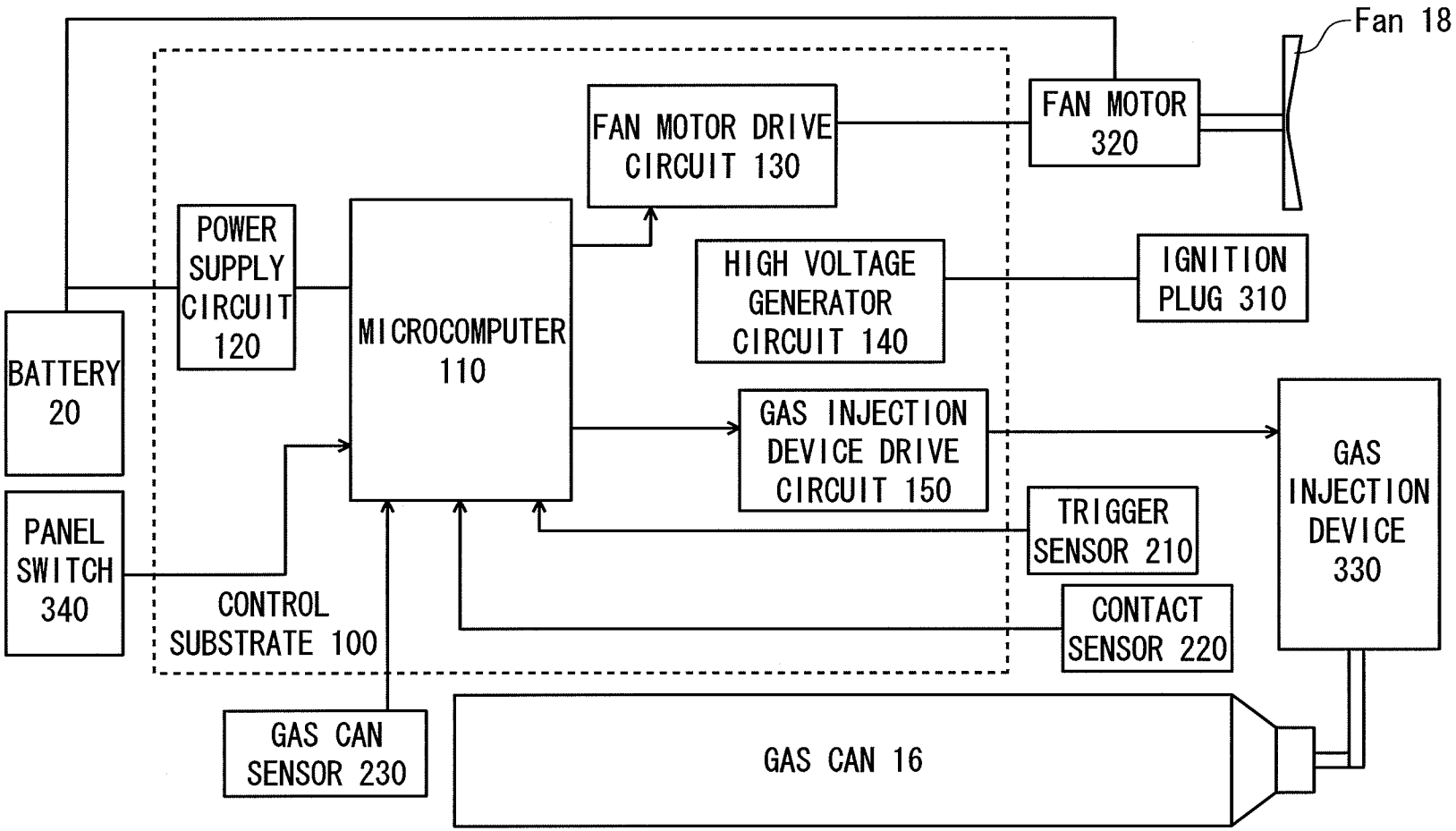
FIG. 2 is a block diagram of the gas combustion type fastening tool.

To the microcomputer 10, as shown in FIG. 2, there are connected three sensors, namely, a trigger sensor 210, a contact sensor 220 and a gas can sensor 230.

The trigger sensor 210 is a switch which is disposed in the vicinity of a trigger 15 and is turned on when the trigger 15 is pulled. When the trigger sensor 210 is turned on, a trigger input signal (a signal for operating the internal mechanism) is output to the microcomputer 110. On receiving this trigger input signal, the microcomputer 110 outputs an operation signal to an ignition plug 310 using the high voltage generator circuit 140, thereby causing the ignition plug 310 to generate an ignition spark.

The contact sensor 220 is a switch which is disposed above the contact member 14 and is turned on when the contact member 14 is pressed against a driven member and is moved upward relative to the body 17. When the contact sensor 220 is turned on, a contact input signal (a signal for preparing the operation of the internal mechanism) is output to the microcomputer 110. On receiving the contact input signal, the microcomputer 110 outputs an operation signal to the gas injection device 330 using the gas injection device drive circuit 150, thereby causing the gas injection device 330 to inject a predetermined amount of gas. Simultaneously, the microcomputer 110 outputs an operation signal to the fan motor 320 using the fan motor drive circuit 130 to operate the fan motor 320, thereby rotating the fan 18. Thus, a mixed gas is generated in the combustion chamber, thereby providing a state where the preparation of the operation of the drive piston/cylinder mechanism is completed.

The gas can sensor 230 is a switch which is used to detect the opening/closing of the cover of the gas can 16 and is turned on when the cover of the gas can 16 is closed. This switch can detect indirectly whether the gas can disposed within the gas combustion type fastening tool 10 is present or not. When the gas sensor 230 is turned on, a gas can input signal is output to the microcomputer 110. The gas can input signal is used to prevent the gas combustion type fastening tool 10 against operation in a state where the cover of the gas can 16 is open: thus, in a state where the gas can input signal is not output, the gas injection device drive circuit 150, fan motor drive circuit 130 and high voltage generator circuit 140 are prevented against operation.

Here, the microcomputer 110 according to this embodiment is structured such that it does not accept the inputs of the trigger sensor 210, contact sensor 220 and gas can sensor 230 until a predetermined condition is established after a driving operation by the gas combustion type fastening tool 10 is executed. For example, until a predetermined time passes after the time when the operation signal is output to the ignition plug 310 using the high voltage generator circuit 140, even when the microcomputer 110 receives the trigger input signal, contact input signal or gas can input signal, the microcomputer 110 ignores such signal.

Therefore, even when the hold position of the gas can held by an elastic member such as a spring within the gas combustion type fastening tool 10 is caused to shift instantaneously by the impact, the microcomputer 10 ignores this position shift, thereby being able to prevent the wrong determination that the gas can is absent.

Figure 3:
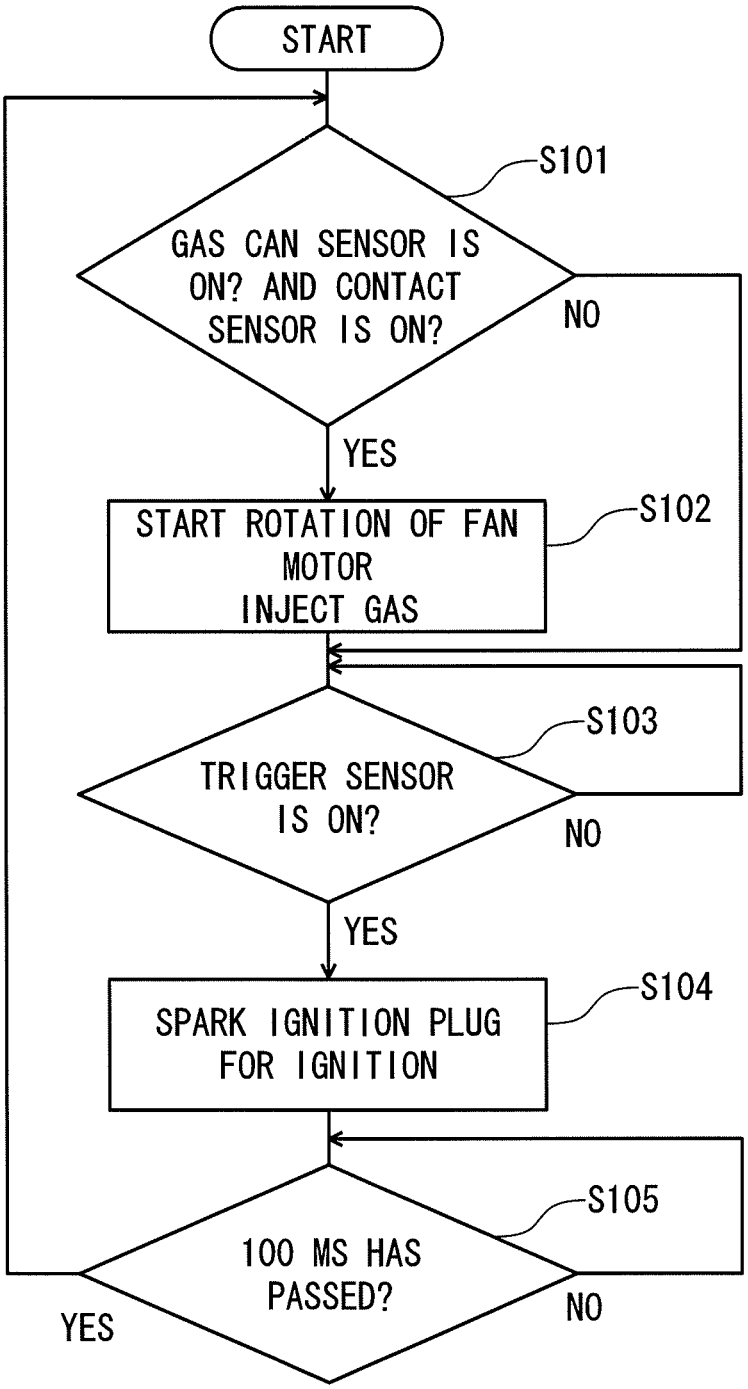
FIG. 3 is a control flow view of the gas combustion type fastening tool.

FIG. 3 is a flow chart of control to be taken by the microcomputer 110.

As shown in FIG. 3, firstly, in Step S101, it is checked whether the gas can sensor 230 and contact sensor 220 are on or not (whether the microcomputer 110 has received the gas can input signal and contact input signal or not). When any one of or both of the gas can sensor 230 and contact sensor 220 is or are off, the gas is not injected but the microcomputer advances to Step S103. On the other hand, when both of the gas can sensor 230 and contact sensor 220 are on, the microcomputer advances to Step S102.

In Step S102, the microcomputer 110 operates the gas injection device 330 using the gas injection device drive circuit 150, thereby injecting a predetermined amount of gas into the combustion chamber. Simultaneously, the microcomputer 110 operates the fan motor 320 using the fan motor drive circuit 130, whereby the fan 18 is rotated within the combustion chamber. Accordingly, a mixed gas is generated within the combustion chamber, thereby completing the preparation for operation of the drive piston/cylinder mechanism. And, the microcomputer advances to Step S103.

In Step S103, the microcomputer 110 waits until the trigger sensor 210 is turned on (the microcomputer 110 receives the trigger input signal). When the trigger sensor 210 is turned on, the microcomputer 110 advances to Step S104.

In Step S104, the microcomputer 110 causes the ignition plug 310 to spark using the high voltage generator circuit 140. In this case, when the operation preparation of the drive piston/cylinder mechanism is completed in Step S102, the mixed gas is combusted within the combustion chamber to cause the drive piston within the drive cylinder to slide, thereby driving a fastening member into the driven member. And, time measurement by an internal timer is started at the timing when the operation signal is output to the ignition plug 310. On the other hand, when the operation preparation of the drive piston/cylinder mechanism is not completed because any one of or both of the gas can sensor 230 and contact sensor 220 is or are off, the drive piston does not slide nor the fastening member is driven. And, the microcomputer advances to Step S105.

In Step S105, the microcomputer 110 refers to the value of the internal timer and waits until 100 ms passes after the operation signal is output to the ignition plug 310. While waiting, the microcomputer is prevented from receiving the inputs from the trigger sensor 210 and contact sensor 220. And, after passage of 100 ms, the microcomputer 110 returns to Step S101, thereby providing a state where the next drive cycle can be started.

Here, there may also be employed a mechanism in which, in the case that the microcomputer advances to Step S103 without executing the gas injection in Step S101, even when the trigger 15 is pulled using the mechanic operation of the contact member 14, the trigger sensor 210 is prevented from turning on.

As has been described above, according to this embodiment, the microcomputer 110 serving as a control unit does not accept the inputs from sensors until a predetermined condition is established after the internal mechanism (the drive piston/cylinder mechanism) is operated. That is, during a predetermined period of time after generation of an impact, the sensors (trigger sensor 210, contact sensor 220 and gas can sensor 230) for outputting signals necessary for operation of the internal mechanism are nullified. Thus, even when the sensors are caused to malfunction by an impact, the internal mechanism is prevented against operation. Therefore, the malfunction of the sensors caused by the impact can be prevented without depending on a mechanical structure such as an impact damping device or an impact absorbing mechanism.

Here, in the gas combustion type fastening tool 10 according to this embodiment, there is disposed the fan used to mix the combustible gas injected into the combustion chamber with the air to generate the mixed gas. However, this is not limitative but, even in a structure not including the fan 18 within the combustion chamber, similar control is possible.

Also, in the above embodiment, description has been given with reference to the gas combustion type fastening tool 10 as an impact tool but this is not limitative. The invention can also apply similarly to other impact tools, for example, a compressed air type droving tool which operates a drive piston using the pressure of compressed air to drive a fastening member, an electric driving tool, and a rotary driving tool such as an impact driver and an impact wrench.

Also, in the above embodiment, the trigger sensor 210 and contact sensor 220 are both nullified. However, since the malfunction can be prevented so long as at least one of the sensors for outputting signals necessary to operate the internal mechanism, only one of the multiple sensors may also be nullified.

In the above embodiment, the time measurement is started when the microcomputer 110 transmits a signal for operating the internal mechanism (when an operation signal is output to the ignition plug 310), and the nullification of the sensors is removed when a predetermined time has passed since the transmission of the signal. However, this is not limitative but the time measurement may also be started when the microcomputer 110 receives a signal output when the ignition plug 310 is actually ignited and the nullification of the signal may be removed after a predetermined time has passed since the reception of the signal, or, the time measurement may also be started when the microcomputer 110 receives a signal for operating the internal mechanism (for example, at the time when it receives an trigger input signal from the trigger sensor 210) and the nullification of the sensors may be removed after a predetermined time has passed since the reception of the signal.

Here, the time for removing the nullification of the sensors may be set as the time from the generation of an impact to the dying-away of the impact. For example, in a driving tool such as the gas combustion type fastening tool 10, in order to avoid interference with the continuous use of the tool (in order not to affect the rapid injection performance of the tool), as short as possible time (for example, 50 ms-300 ms) may preferably be set.

Also, in the above embodiment, the predetermined time is set as a fixed time. However, the impact tool may also have a panel switch 340 connected to the microcomputer 110 in such a manner that it can set the predetermined time variably and arbitrarily. In this case, even when tool using environments or tool using conditions vary (for example, an environment where the pressure of the gas can 16 is caused to vary due to the atmospheric temperature difference or altitude drop), by a user arbitrarily changing the setting of the predetermined time, an operation proper for the state of the environment can be realized. Or, by increasing the predetermined time, a priority can be given to the positive operation of the tool while sacrificing the rapid injection performance of the tool to some degrees.

In the above embodiment, the nullification of the sensors is removed using the time measurement. However, this is not limitative. For example, there may also be provided an impact sensor capable of detecting an impact generated by the internal mechanism and, until the magnitude of the impact detected by the impact sensor reaches a predetermined threshold value or less, the sensors may be nullified. In other words, until, when an impact is generated, the impact dies away, there may also be nullified at least one of the sensors outputting signals necessary to operate the internal mechanism. This structure can prevent the malfunction of the sensors even when the time necessary for the dying-away of the impact is indefinite. Therefore, even in a tool such as an impact driver or an impact wrench which operates continuously for indefinite time, the malfunction can be prevented.

What is claimed is:

1. An impact tool workable by generating an impact using an internal mechanism, comprising:

a control unit that controls the internal mechanism; and a sensor that outputs a signal for operating the internal mechanism or a signal for preparing an operation of the internal mechanism, to the control unit, wherein the control is configured to nullify an input of the sensor when the sensor malfunctions, until a predetermined condition is established after the internal mechanism is operated.

2. The impact tool according to claim 1, wherein the predetermined condition is that a predetermined time passes since the control unit received the signal for operating the internal mechanism, or, that a predetermined time passes since the control unit transmits the signal for operating the internal mechanism.

3. The impact tool according to claim 1, further comprising:

an impact sensor that detects an impact generated by the internal mechanism, wherein the predetermined condition is that a magnitude of the impact to be detected by the impact sensor is a predetermined threshold value or less.

4. The impact tool according to claim 1, wherein the impact tool is a gas combustion type fastening tool for driving a fastening member by operating a drive piston using combustion pressure, the fastening tool includes a gas injection device for injecting gas fuel into a combustion chamber and an ignition plug for generating a spark for combusting a mixed gas constituted of the gas fuel and air, the sensor includes:

a first sensor which outputs at least any one of a signal for operating the gas injection device and a signal for operating a fan for stirring up the air within the combustion chamber, to the control unit; and a second sensor which outputs a signal for operating the ignition plug to the control unit, and the control unit, until the predetermined condition is established after the internal mechanism is operated, is configured to nullify an input of at least any one of the first and second sensors.

5. The impact tool according to claim 1, wherein the impact tool is a gas combustion type fastening tool for driving a fastening member by operating a drive piston using combustion pressure, the fastening tool includes a gas injection device for injecting gas fuel from a gas can into a combustion chamber and an ignition plug for generating a spark for combusting a mixed gas constituted of the gas fuel and air, the sensor includes:

a first sensor which outputs at least any one of a signal for operating the gas injection device and a signal for operating a fan for stirring up the air within the combustion chamber, to the control unit;

a second sensor which outputs a signal for operating the ignition plug to the control unit; and a third sensor which outputs a signal when the gas can is detected, and the control unit, until the predetermined condition is established after the internal mechanism is operated, is configured to nullify an input of at least any one of the first, second and third sensors.

* * * * *